US011480890B2

(12) United States Patent
Nakai

(10) Patent No.: US 11,480,890 B2
(45) Date of Patent: Oct. 25, 2022

(54) IMAGE FORMING APPARATUS AND IMAGE FORMING SYSTEM CAPABLE OF CALCULATING ACTUAL DEVELOPMENT CURRENT USING BLANK PORTION CURRENT AND MEASURING DEVELOPMENT CURRENT

(71) Applicant: KYOCERA Document Solutions Inc., Osaka (JP)

(72) Inventor: Jun Nakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/501,551

(22) Filed: Oct. 14, 2021

(65) Prior Publication Data

US 2022/0128924 A1 Apr. 28, 2022

(30) Foreign Application Priority Data

Oct. 23, 2020 (JP) ..... JP2020-178185

(51) Int. Cl.
*G03G 15/06* (2006.01)
*G03G 15/00* (2006.01)

(52) U.S. Cl.
CPC ..... *G03G 15/065* (2013.01); *G03G 15/5041* (2013.01)

(58) Field of Classification Search
CPC ... G03G 15/06; G03G 15/065; G03G 15/5041
USPC ..... 399/38, 53–56
See application file for complete search history.

(56) References Cited

U.S. PATENT DOCUMENTS 7,072,597 B2 * 7/2006 Shimura ..... G03G 15/5058 399/49

FOREIGN PATENT DOCUMENTS

JP 2010-019969 A 1/2010

* cited by examiner

*Primary Examiner* — Hoan H Tran
(74) *Attorney, Agent, or Firm* — IP Business Solutions, LLC

(57) ABSTRACT

An image forming apparatus includes: a developing roller; a photosensitive drum; a first measurement device that measures a blank portion current in a first line on the photosensitive drum which extends in a scanning direction of the photosensitive drum and on which no toner patch is formed; a second measurement device that measures a measuring development current in a second line on the photosensitive drum which extends in the scanning direction of the photosensitive drum and on which a toner patch is formed; and a control device that functions as a patch setter and a first calculator. The patch setter sets a patch width of the toner patch in the scanning direction of the photosensitive drum. The first calculator calculates an actual development current based on a developable width of the photosensitive drum in the scanning direction, the patch width, the blank portion current, and the measuring development current.

8 Claims, 22 Drawing Sheets

Fig.9A

PROCESS LINEAR VELOCITY 200 mm/sec WIDTH 330 mm

| | | D[g/m²] | | | | | |
|---|---|---|---|---|---|---|---|
| | | 1 | 2 | 3 | 4 | 5 | 6 |
| Q/M [μc/g] | 10 | 0.7 | 1.3 | 2.0 | 2.6 | 3.3 | 4.0 |
| | 15 | 1.0 | 2.0 | 3.0 | 4.0 | 5.0 | 5.9 |
| | 20 | 1.3 | 2.6 | 4.0 | 5.3 | 6.6 | 7.9 |
| | 25 | 1.7 | 3.3 | 5.0 | 6.6 | 8.3 | 9.9 |
| | 30 | 2.0 | 4.0 | 5.9 | 7.9 | 9.9 | 11.9 |
| | 35 | 2.3 | 4.6 | 6.9 | 9.2 | 11.6 | 13.9 |
| | 40 | 2.6 | 5.3 | 7.9 | 10.6 | 13.2 | 15.8 |
| | 45 | 3.0 | 5.9 | 8.9 | 11.9 | 14.9 | 17.8 |
| | 50 | 3.3 | 6.6 | 9.9 | 13.2 | 16.5 | 19.8 |
| | 55 | 3.6 | 7.3 | 10.9 | 14.5 | 18.2 | 21.8 |
| | 60 | 4.0 | 7.9 | 11.9 | 15.8 | 19.8 | 23.8 |

Fig.9B

PROCESS LINEAR VELOCITY 300 mm/sec WIDTH 330 mm

| Q/M [μc/g] | D[g/m²] 1 | 2 | 3 | 4 | 5 | 6 |
|---|---|---|---|---|---|---|
| 10 | 1.0 | 2.0 | 3.0 | 4.0 | 5.0 | 5.9 |
| 15 | 1.5 | 3.0 | 4.5 | 5.9 | 7.4 | 8.9 |
| 20 | 2.0 | 4.0 | 5.9 | 7.9 | 9.9 | 11.9 |
| 25 | 2.5 | 5.0 | 7.4 | 9.9 | 12.4 | 14.9 |
| 30 | 3.0 | 5.9 | 8.9 | 11.9 | 14.9 | 17.8 |
| 35 | 3.5 | 6.9 | 10.4 | 13.9 | 17.3 | 20.8 |
| 40 | 4.0 | 7.9 | 11.9 | 15.8 | 19.8 | 23.8 |
| 45 | 4.5 | 8.9 | 13.4 | 17.8 | 22.3 | 26.7 |
| 50 | 5.0 | 9.9 | 14.9 | 19.8 | 24.8 | 29.7 |
| 55 | 5.4 | 10.9 | 16.3 | 21.8 | 27.2 | 32.7 |
| 60 | 5.9 | 11.9 | 17.8 | 23.8 | 29.7 | 35.6 |

Fig.10A

PROCESS LINEAR VELOCITY 400 mm/sec WIDTH 330 mm

| Q/M [μc/g] | D[g/m²] 1 | 2 | 3 | 4 | 5 | 6 |
|---|---|---|---|---|---|---|
| 10 | 1.3 | 2.6 | 4.0 | 5.3 | 6.6 | 7.9 |
| 15 | 2.0 | 4.0 | 5.9 | 7.9 | 9.9 | 11.9 |
| 20 | 2.6 | 5.3 | 7.9 | 10.6 | 13.2 | 15.8 |
| 25 | 3.3 | 6.6 | 9.9 | 13.2 | 16.5 | 19.8 |
| 30 | 4.0 | 7.9 | 11.9 | 15.8 | 19.8 | 23.8 |
| 35 | 4.6 | 9.2 | 13.9 | 18.5 | 23.1 | 27.7 |
| 40 | 5.3 | 10.6 | 15.8 | 21.1 | 26.4 | 31.7 |
| 45 | 5.9 | 11.9 | 17.8 | 23.8 | 29.7 | 35.6 |
| 50 | 6.6 | 13.2 | 19.8 | 26.4 | 33.0 | 39.6 |
| 55 | 7.3 | 14.5 | 21.8 | 29.0 | 36.3 | 43.6 |
| 60 | 7.9 | 15.8 | 23.8 | 31.7 | 39.6 | 47.5 |

Fig.10B

PROCESS LINEAR VELOCITY 500 mm/sec WIDTH 330 mm

| Q/M [μc/g] | D[g/m²] 1 | 2 | 3 | 4 | 5 | 6 |
|---|---|---|---|---|---|---|
| 10 | 1.7 | 3.3 | 5.0 | 6.6 | 8.3 | 9.9 |
| 15 | 2.5 | 5.0 | 7.4 | 9.9 | 12.4 | 14.9 |
| 20 | 3.3 | 6.6 | 9.9 | 13.2 | 16.5 | 19.8 |
| 25 | 4.1 | 8.3 | 12.4 | 16.5 | 20.6 | 24.8 |
| 30 | 5.0 | 9.9 | 14.9 | 19.8 | 24.8 | 29.7 |
| 35 | 5.8 | 11.6 | 17.3 | 23.1 | 28.9 | 34.7 |
| 40 | 6.6 | 13.2 | 19.8 | 26.4 | 33.0 | 39.6 |
| 45 | 7.4 | 14.9 | 22.3 | 29.7 | 37.1 | 44.6 |
| 50 | 8.3 | 16.5 | 24.8 | 33.0 | 41.3 | 49.5 |
| 55 | 9.1 | 18.2 | 27.2 | 36.3 | 45.4 | 54.5 |
| 60 | 9.9 | 19.8 | 29.7 | 39.6 | 49.5 | 59.4 |

Fig.11A

PROCESS LINEAR VELOCITY 200 mm/sec PATCH WIDTH 330 mm

| Q/M [μc/g] | D[g/m²] 1 | 2 | 3 | 4 | 5 | 6 |
|---|---|---|---|---|---|---|
| 10 | 0.7 | 1.3 | 2.0 | 2.6 | 3.3 | 4.0 |
| 15 | 1.0 | 2.0 | 3.0 | 4.0 | 5.0 | 5.9 |
| 20 | 1.3 | 2.6 | 4.0 | 5.3 | 6.6 | 7.9 |
| 25 | 1.7 | 3.3 | 5.0 | 6.6 | 8.3 | 9.9 |
| 30 | 2.0 | 4.0 | 5.9 | 7.9 | 9.9 | 11.9 |
| 35 | 2.3 | 4.6 | 6.9 | 9.2 | 11.6 | 13.9 |
| 40 | 2.6 | 5.3 | 7.9 | 10.6 | 13.2 | 15.8 |
| 45 | 3.0 | 5.9 | 8.9 | 11.9 | 14.9 | 17.8 |
| 50 | 3.3 | 6.6 | 9.9 | 13.2 | 16.5 | 19.8 |
| 55 | 3.6 | 7.3 | 10.9 | 14.5 | 18.2 | 21.8 |
| 60 | 4.0 | 7.9 | 11.9 | 15.8 | 19.8 | 23.8 |

Fig.11B

PROCESS LINEAR VELOCITY 300 mm/sec PATCH WIDTH 220 mm

| Q/M [μc/g] | D[g/m²] 1 | 2 | 3 | 4 | 5 | 6 |
|---|---|---|---|---|---|---|
| 10 | 0.7 | 1.3 | 2.0 | 2.6 | 3.3 | 4.0 |
| 15 | 1.0 | 2.0 | 3.0 | 4.0 | 5.0 | 5.9 |
| 20 | 1.3 | 2.6 | 4.0 | 5.3 | 6.6 | 4.9 |
| 25 | 1.7 | 3.3 | 5.0 | 6.6 | 8.3 | 9.9 |
| 30 | 2.0 | 4.0 | 5.9 | 7.9 | 9.9 | 11.9 |
| 35 | 2.3 | 4.6 | 6.9 | 9.2 | 11.6 | 13.9 |
| 40 | 2.6 | 5.3 | 7.9 | 10.6 | 13.2 | 15.8 |
| 45 | 3.0 | 5.9 | 8.9 | 11.9 | 14.9 | 17.8 |
| 50 | 3.3 | 6.6 | 9.9 | 13.2 | 16.5 | 19.8 |
| 55 | 3.6 | 7.3 | 10.9 | 14.5 | 18.2 | 21.8 |
| 60 | 4.0 | 7.9 | 11.9 | 15.8 | 19.8 | 23.8 |

Fig.12A

PROCESS LINEAR VELOCITY 400 mm/sec PATCH WIDTH 165 mm

| Q/M [μc/g] | D[g/m²] 1 | 2 | 3 | 4 | 5 | 6 |
|---|---|---|---|---|---|---|
| 10 | 0.7 | 1.3 | 2.0 | 2.6 | 3.3 | 4.0 |
| 15 | 1.0 | 2.0 | 3.0 | 4.0 | 5.0 | 5.9 |
| 20 | 1.3 | 2.6 | 4.0 | 5.3 | 6.6 | 7.9 |
| 25 | 1.7 | 3.3 | 5.0 | 6.6 | 8.3 | 9.9 |
| 30 | 2.0 | 4.0 | 5.9 | 7.9 | 9.9 | 11.9 |
| 35 | 2.3 | 4.6 | 6.9 | 9.2 | 11.6 | 13.9 |
| 40 | 2.6 | 5.3 | 7.9 | 10.6 | 13.2 | 15.8 |
| 45 | 3.0 | 5.9 | 8.9 | 11.9 | 14.9 | 17.8 |
| 50 | 3.3 | 6.6 | 9.9 | 13.2 | 16.5 | 19.8 |
| 55 | 3.6 | 7.3 | 10.9 | 14.5 | 18.2 | 21.8 |
| 60 | 4.0 | 7.9 | 11.9 | 15.8 | 19.8 | 23.8 |

Fig.12B

PROCESS LINEAR VELOCITY 500 mm/sec PATCH WIDTH 132 mm

| Q/M [μc/g] | D[g/m²] 1 | 2 | 3 | 4 | 5 | 6 |
|---|---|---|---|---|---|---|
| 10 | 0.7 | 1.3 | 2.0 | 2.6 | 3.3 | 4.0 |
| 15 | 1.0 | 2.0 | 3.0 | 4.0 | 5.0 | 5.9 |
| 20 | 1.3 | 2.6 | 4.0 | 5.3 | 6.6 | 7.9 |
| 25 | 1.7 | 3.3 | 5.0 | 6.6 | 8.3 | 9.9 |
| 30 | 2.0 | 4.0 | 5.9 | 7.9 | 9.9 | 11.9 |
| 35 | 2.3 | 4.6 | 6.9 | 9.2 | 11.6 | 13.9 |
| 40 | 2.6 | 5.3 | 7.9 | 10.6 | 13.2 | 15.8 |
| 45 | 3.0 | 5.9 | 8.9 | 11.9 | 14.9 | 17.8 |
| 50 | 3.3 | 6.6 | 9.9 | 13.2 | 16.5 | 19.8 |
| 55 | 3.6 | 7.3 | 10.9 | 14.5 | 18.2 | 21.8 |
| 60 | 4.0 | 7.9 | 11.9 | 15.8 | 19.8 | 23.8 |

PROCESS LINEAR VELOCITY 200 mm/sec

PATCH WIDTH 330 mm

PROCESS LINEAR VELOCITY 300 mm/sec

PATCH WIDTH 220 mm

PROCESS LINEAR VELOCITY 400 mm/sec

PATCH WIDTH 165 mm

PROCESS LINEAR VELOCITY 500 mm/sec

PATCH WIDTH 132 mm

IMAGE FORMING APPARATUS AND IMAGE FORMING SYSTEM CAPABLE OF CALCULATING ACTUAL DEVELOPMENT CURRENT USING BLANK PORTION CURRENT AND MEASURING DEVELOPMENT CURRENT

INCORPORATION BY REFERENCE

This application claims priority to Japanese Patent Application No. 2020-178185 filed on 23 Oct. 2020, the entire contents of which are incorporated by reference herein.

BACKGROUND

The present disclosure relates to image forming apparatuses and image forming systems.

Generally, a technique is known for calculating the amount of electric charge on toner transferred from a developing roller to a photosensitive drum by measuring the value of a development current flowing from the developing roller into the photosensitive drum.

SUMMARY

A technique improved over the aforementioned technique is proposed as one aspect of the present disclosure.

An image forming apparatus according to an aspect of the present disclosure includes a developing roller, a photosensitive drum, a first measurement device, a second measurement device, and a control device. The developing roller carries a toner. The photosensitive drum carries a toner image developed from an electrostatic latent image by the toner carried on the developing roller. The first measurement device measures a blank portion current in a first line on the photosensitive drum which extends in a scanning direction of the photosensitive drum and on which no toner patch is formed. The second measurement device measures a measuring development current in a second line on the photosensitive drum which extends in the scanning direction of the photosensitive drum and on which a toner patch is formed. The control device includes a processor and functions, through the processor executing a control program, as a patch setter and a first calculator. The patch setter sets a patch width of the toner patch in the scanning direction of the photosensitive drum. The first calculator calculates an actual development current based on a developable width of the photosensitive drum in the scanning direction of the photosensitive drum, the patch width, the blank portion current, and the measuring development current.

BRIEF DESCRIPTION OF THE DRAWINGS

FIGS. 9A to 12B are tables showing changes of development current in the developing device.

DETAILED DESCRIPTION

Figure 1:
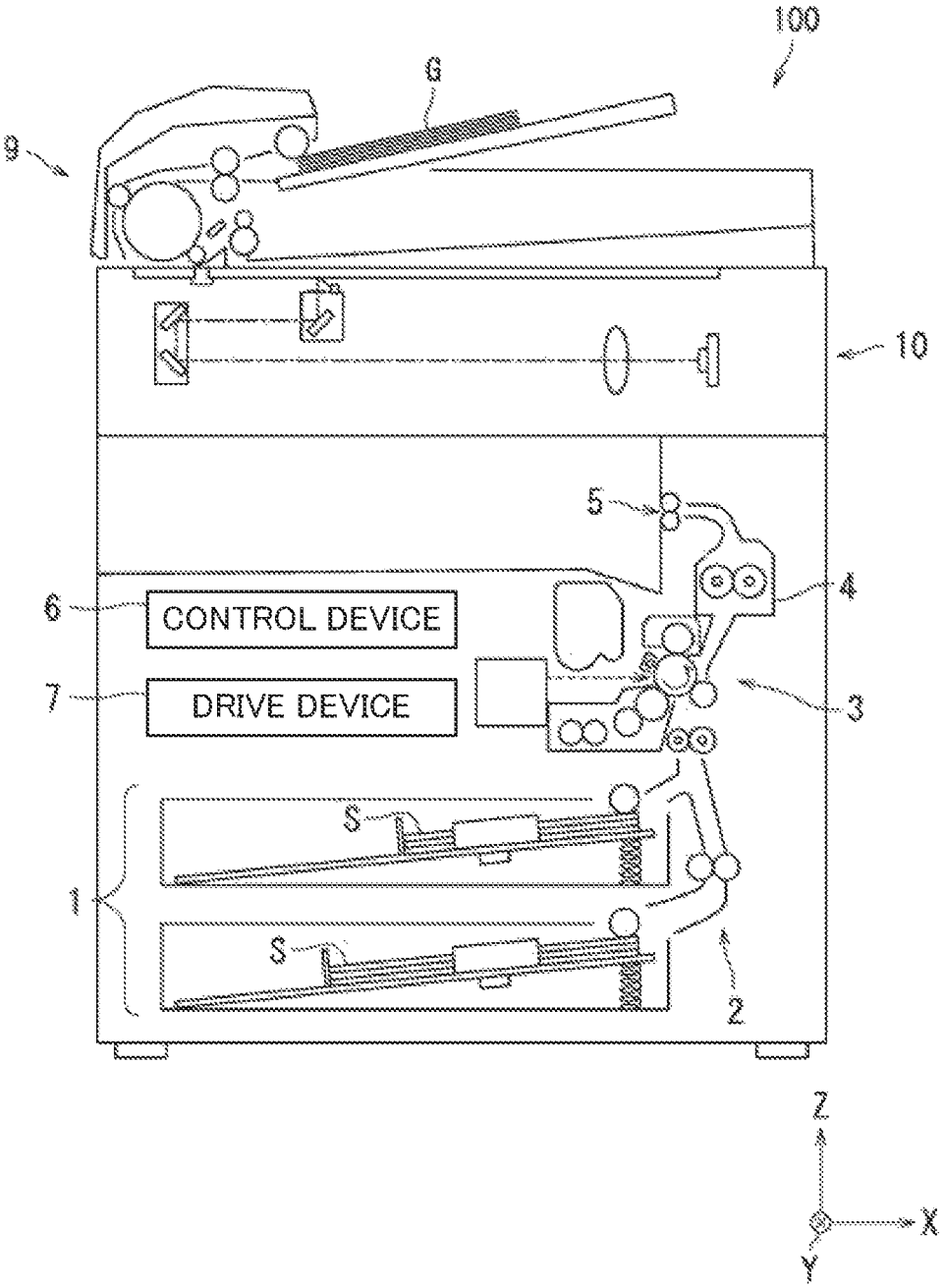
FIG. 1 is a view showing a structure of an image forming apparatus.

Hereinafter, a description will be given of embodiments of the present disclosure with reference to the drawings. Throughout the drawings, the same or corresponding parts are designated by the same references and further explanation thereof will be omitted. In these embodiments, the X axis, Y axis, and Z axis perpendicular to each other are shown in the drawing. The Z axis is parallel to the vertical plane and the X and Y axes are parallel to the horizontal plane.

First Embodiment

Referring to FIGS. 1 to 6B, an image forming apparatus 100 according to a first embodiment of the present disclosure includes: a developing roller 321; a photosensitive drum 33; a first measurement device 322; a second measurement device 323; and a control device 6 that includes a processor and functions, through the processor executing a control program, as a patch setter 36 and a first calculator 324.

The developing roller 321 carries a toner T. The photosensitive drum 33 carries a toner image developed from an electrostatic latent image by the toner T carried on the developing roller 321. The first measurement device 322 measures a blank portion current Iw in a first line A on the photosensitive drum 33 which extends in a scanning direction R3 of the photosensitive drum 33 and on which no toner patch P is formed. The blank portion current Iw has a direction. The blank portion current Iw may be appropriately described also as a blank portion current value Iw. The scanning direction R3 (a direction where an axis of rotation of the photosensitive drum 33 extends) may also be described as a main scanning direction R3 or a widthwise direction R3.

The second measurement device 323 measures a measuring development current Id in a second line B on the photosensitive drum 33 which extends in the scanning direction R3 of the photosensitive drum 33 and on which a toner patch P is formed. The patch setter 36 sets a patch width W of the toner patch P in the scanning direction R3 of the photosensitive drum 33. The first calculator 324 calculates an actual development current Io based on a developable width Wo of the photosensitive drum 33 in the scanning direction R3, the toner patch width W of the toner patch P in the scanning direction R3, the blank portion current Iw, and the measuring development current Id.

The measuring development current Id has a direction. The measuring development current Id may be appropriately described also as a measuring development current value Id depending on the content of explanation. The actual development current Io flows from the developing roller 321 to the photosensitive drum 33. The actual development current Io may be appropriately described also as an actual development current value Io depending on the content of explanation.

The first calculator 324 calculates the actual development current Io by calculating a first difference (Wo−W) between the developable width Wo and the toner patch width W, calculating the ratio (Wo−W)/Wo of the first difference (Wo−W) to the developable width Wo, calculating the product Iw*(Wo−W)/Wo of the ratio (Wo−W)/Wo and the blank portion current Iw, and calculating a second difference (Id−Iw*(Wo−W)/Wo) between the measuring development current Id and the product Iw*(Wo−W)/Wo.

The product Iw*(Wo−W)/Wo refers to a value of the blank portion current Iw in a second line B on the photosensitive drum 33 which extends in the scanning direction R3 of the photosensitive drum 33 and on which a toner patch P is formed.

The first measurement device 322 measures as the blank portion current Iw an electric current flowing from the photosensitive drum 33 toward the developing roller 321.

The control device 6 further functions as an adjuster 326 and a second calculator 325. The adjuster 326 adjusts, based on the actual development current Io, the development bias voltage Vd to be applied to the developing roller 321. The second calculator 325 calculates an amount of charge on toner (Q/M) based on the actual development current Io. The adjuster 326 adjusts the development bias voltage Vd based on the calculated amount of charge on toner (Q/M).

Figure 2:
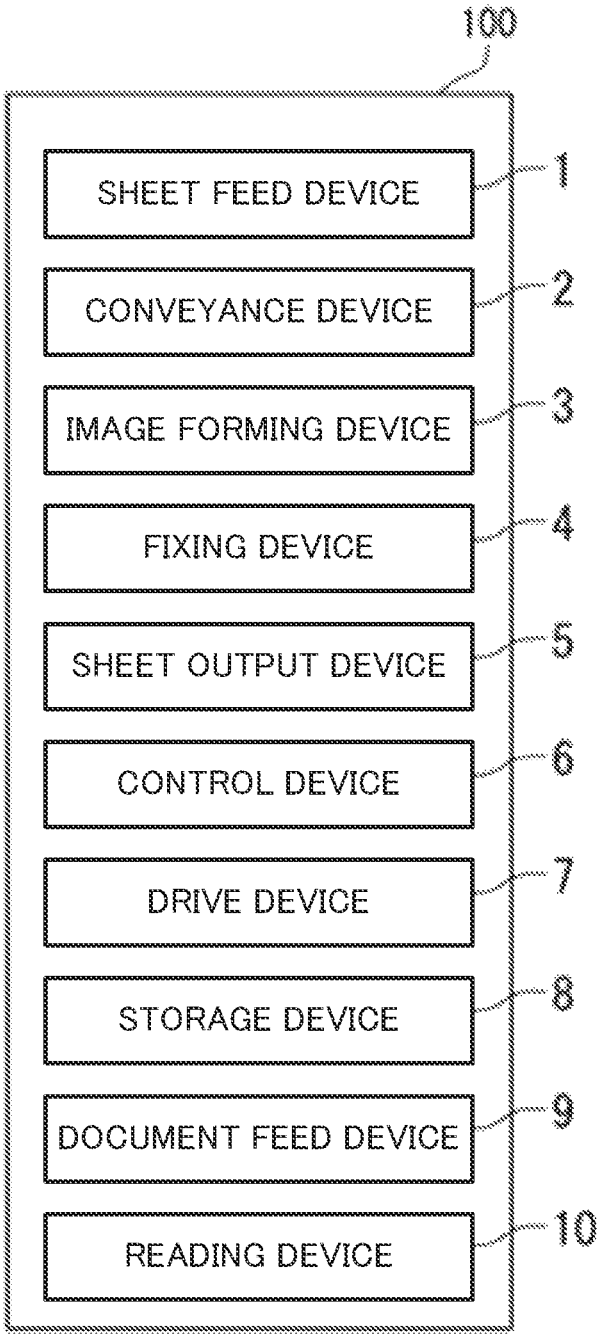
FIG. 2 is a block diagram showing a configuration of the image forming apparatus.

A detailed description will be given of the image forming apparatus 100 according to the first embodiment of the present disclosure with reference to FIGS. 1 and 2. FIG. 1 is a view showing the structure of the image forming apparatus 100. FIG. 2 is a block diagram showing the configuration of the image forming apparatus 100. The image forming apparatus 100 is, for example, a copier, a facsimile machine or a multifunction peripheral having both the functions of a copier and a facsimile machine.

As shown in FIGS. 1 and 2, the image forming apparatus 100 includes a sheet feed device 1, a conveyance device 2, an image forming device 3, a fixing device 4, a sheet output device 5, a control device 6, a drive device 7, a storage device 8, a document feed device 9, and a reading device 10. Specific examples of the image forming apparatus 100 include a printer, a facsimile machine, and an MFP (multifunction printer).

The sheet feed device 1 feeds a sheet S. The sheet feed device 1 includes trays and pick-up rollers. The tray is loaded with sheets S. The pick-up roller picks up a sheet S in the tray and feeds it forward. The sheet S is an example of a recording medium.

The conveyance device 2 conveys the sheet S fed from the sheet feed device 1. The conveyance device 2 has a conveyance path. The conveyance path starts with the sheet feed device 1, passes through the image forming device 3 and the fixing device 4, and extends to the sheet output device 5. The conveyance device 2 includes, in the conveyance path, conveyance rollers and a registration roller. A plurality of conveyance rollers are disposed in the conveyance path and convey the sheet S.

The registration roller adjusts the timing with which the sheet S is conveyed to the image forming device 3. The conveyance device 2 conveys the sheet S from the sheet feed device 1 via the image forming device 3 and the fixing device 4 to the sheet output device 5.

The image forming device 3 forms a toner image on the sheet S by electrophotography based on image data. The image data represents, for example, an image of an original document G. The configuration of the image forming device 3 will be described hereinafter with reference to FIG. 3.

The fixing device 4 applies heat and pressure to the toner image developed on the sheet S to fix the toner image on the sheet S.

The sheet output device 5 discharges the sheet S to the outside of the housing of the image forming apparatus 100. The sheet output device 5 includes a sheet output roller and a sheet output tray. The sheet output roller discharges the sheet S conveyed from the fixing device 4 by the conveyance roller to the sheet output tray. The discharged sheets S are loaded onto the sheet output tray.

The control device 6 controls all of operations of the image forming apparatus 100. The control device 6 includes electronic control components, including a CPU (central processing unit), a ROM (read-only memory), and a RAM (random access memory).

The CPU is a processor for executing various types of arithmetic processing. The ROM is a non-volatile storage device previously storing a control program and like information for use in allowing the CPU to execute various types of processing. The RAM is a volatile or non-volatile storage device for use as a temporary memory (workspace) for various types of processing executed by the CPU.

The drive device 7 is an actuator giving a drive force to each of the drive mechanisms (the sheet feed device 1, the conveyance device 2, the image forming device 3, the fixing device 4, the sheet output device 5, and so on) of the image forming apparatus 100. A specific example of the drive device 7 is a motor.

The storage device 8 stores programs and data. The storage device 8 may temporarily store processing results of the control device 6. The storage device 8 may include an arbitrary storage device, such as a semiconductor storage device or a magnetic-storage device. The storage device 8 may include a combination of a portable storage medium, such as a memory card, and a reading device for reading the storage medium.

The programs stored in the storage device 8 include an application to be executed in the foreground or background and a control program supporting the operation of the application. The application allows the control device 6 to execute, for example, processing according to a gesture. The control program is, for example, an OS (operating system).

The storage device 8 can also be formed as a computer-readable physical carrier (medium) categorizable as a solid-state memory, a magnetic disk or an optical disk. Such a medium stores an appropriate set of computer instructions, such as a program module, for use in allowing the processor to execute the technique disclosed in the first embodiment, and a data structure.

Examples of the computer-readable medium include an electric connection including one or more wirings, a magnetic disk recording medium, a magnetic cassette, a magnetic tape, other magnetic or optical storage devices (for example, a CD (Compact Disk), a Laser Disc (registered trademark), a DVD (Digital Versatile Disc, registered trademark), a floppy (registered trademark) disk, a Blu-ray Disc (registered trademark)), a portable computer disk, a RAM, a ROM, an EPROM (Erasable Programmable Read-Only Memory), an EEPROM (Electrically Erasable Programmable Read-Only Memory, registered trademark), writable and programmable ROMs including a flash memory, other physical recording media capable of storing information, and any combination of them. The memory can be provided at least either inside or outside of the processor or the processing unit.

The storage device 8 stores the toner patch width W, the blank portion current value Iw, the measuring development current value Id, the developable width Wo, the first difference (Wo−W), the ratio (Wo−W)/Wo, the product Iw*(Wo−W)/Wo, and the second difference (Id−Iw*(Wo−W)/Wo), which will be described hereinafter with reference to FIG. 6A.

The document feed device 9 conveys an original document G or the like to the reading device 10. The document feed device 9 is, for example, an ADF (auto document feeder).

The reading device 10 reads an image of the original document G conveyed by the document feed device 9. The reading device 10 creates image data representing the read image. Examples of the reading device 10 include a CIS (contact image sensor) based scanner and a CCD (charge coupled devices) based scanner.

Figure 3:
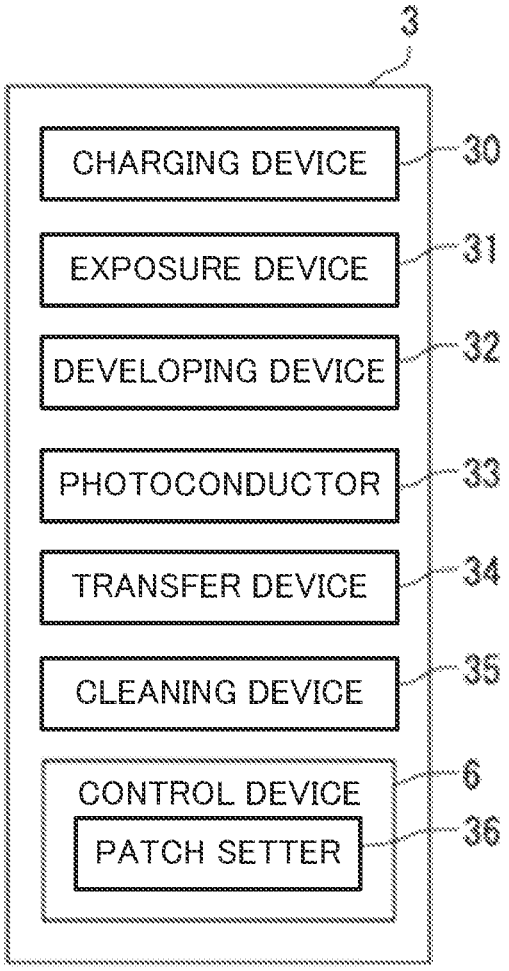
FIG. 3 is a block diagram showing an example of a configuration of an image forming device.
Figure 4:
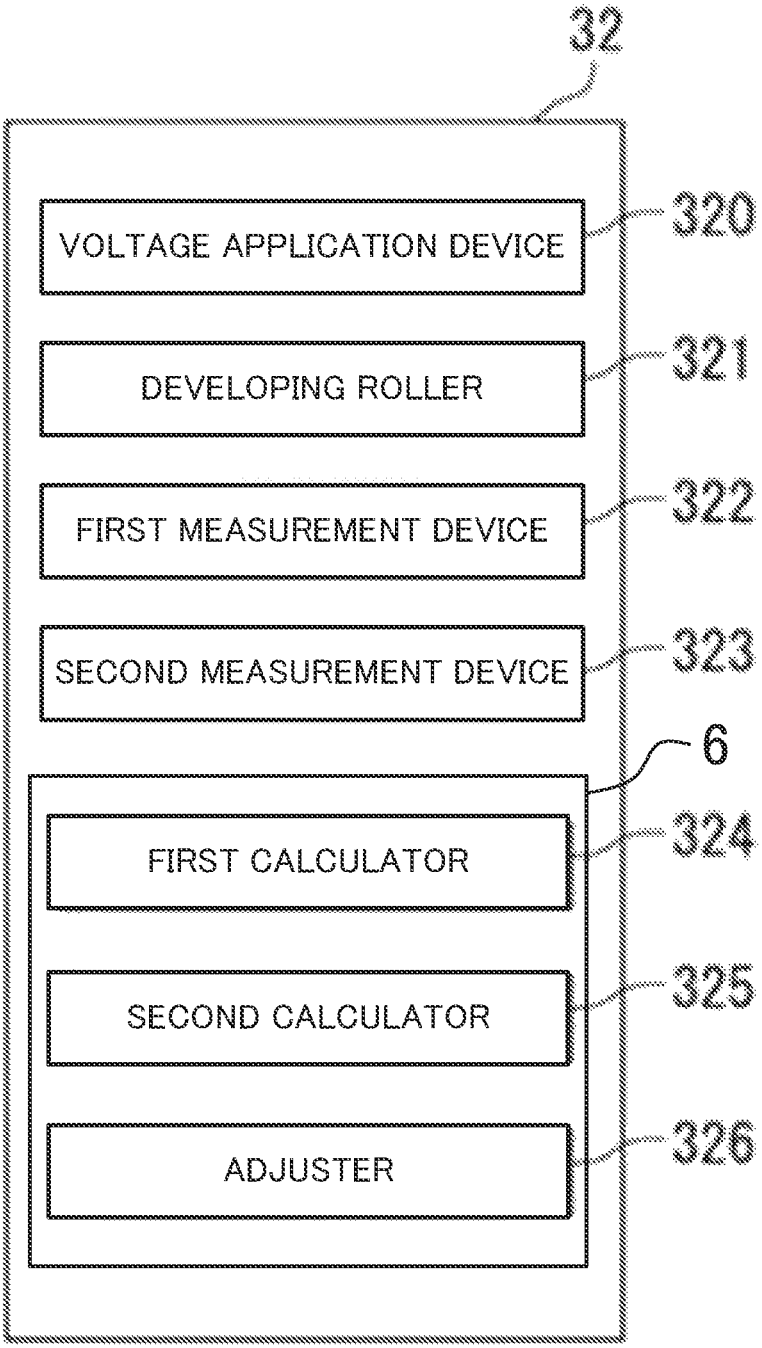
FIG. 4 is a block diagram showing a configuration of a developing device.

Next, a description will be given in detail of the image forming device 3 with reference to not only FIGS. 1 and 2 but also FIGS. 3 to 7. FIG. 3 is a block diagram showing an example of a configuration of the image forming device 3. FIG. 4 is a block diagram showing a configuration of the developing device 32 contained in the image forming device 3.

Figure 5:
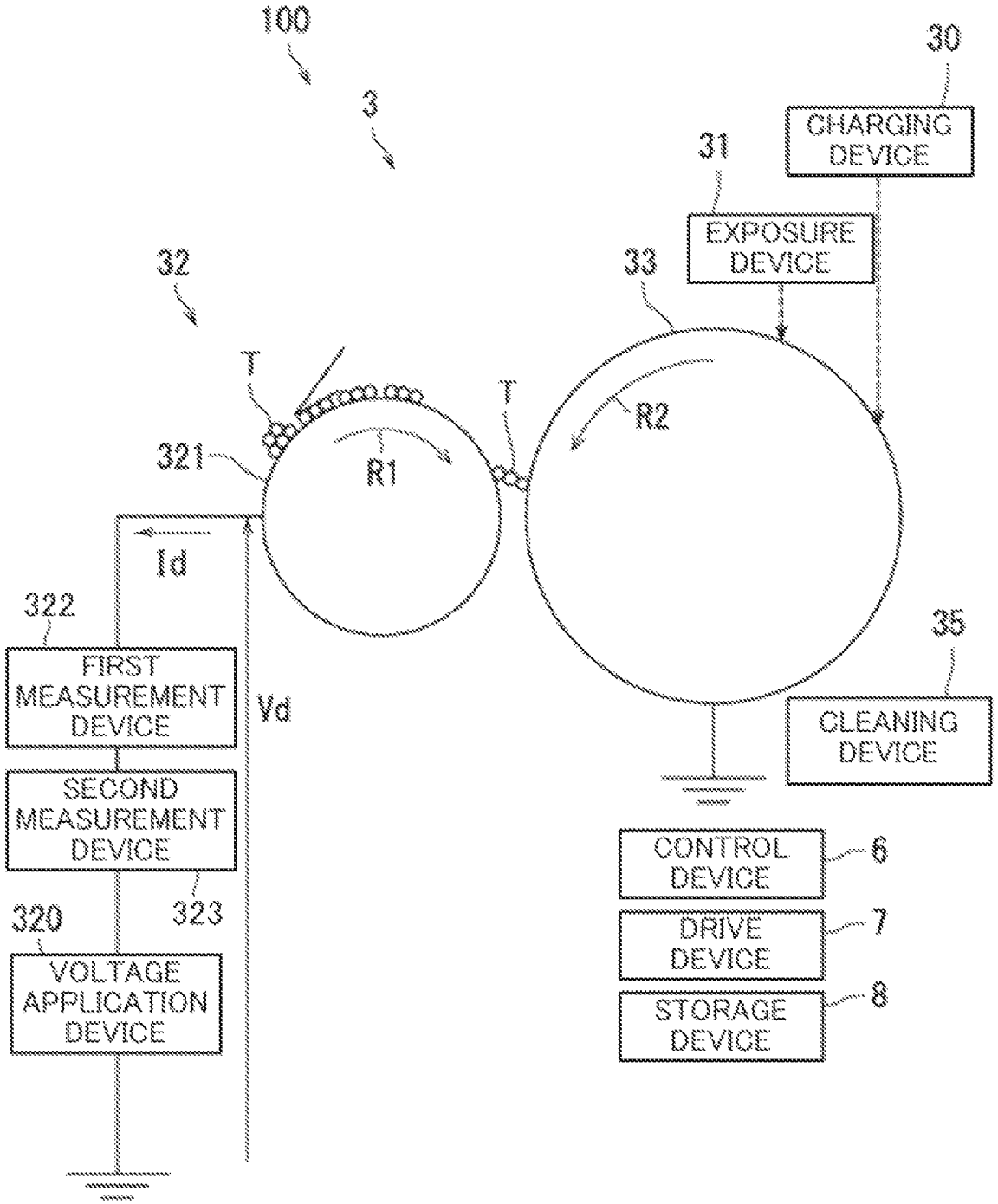
FIG. 5 is a view showing a structure of the developing device.

FIG. 5 is a view showing a structure of the developing device 32. FIGS. 6A and 6B are diagrams showing flows of development current I in the developing device 32. FIG. 7 is a diagram showing a relationship between potentials and amount of toner M in the developing device 32.

The image forming device 3 will be described with reference to FIGS. 3 to 5. As shown in FIGS. 3 to 5, the image forming device 3 includes a charging device 30, an exposure device 31, the developing device 32, the photosensitive drum 33, a transfer device 34, a cleaning device 35, and a part of the control device 6.

The charging device 30 charges a photosensitive layer of the photosensitive drum 33 with a predetermined potential. The charging device 30 may charge the photosensitive drum 33 by non-contact charging with a corona charger with a grid (a scorotron charger) or by contact charging with a rubber roller.

The exposure device 31 irradiates the photosensitive layer of the photosensitive drum 33 with laser light to make the photosensitive layer exposed. The exposure device 31 exposes the photosensitive drum 33 to light based on the image data. As a result, an electrostatic latent image is formed on the surface of the photosensitive drum 33.

The developing device 32 contains, as an example, a two-component developer containing a carrier made of a magnetic material and a toner T. The developing device 32 develops the electrostatic latent image formed on the surface of the photosensitive drum 33 with the toner T to form a toner image on the surface of the photosensitive drum 33.

The photosensitive drum 33 is a drum with an axis of rotation. The photosensitive drum 33 rotates around the axis of rotation. The photosensitive drum 33 includes the photosensitive layer on the outer periphery. The photosensitive drum 33 carries the toner image developed from the electrostatic latent image with the toner T carried on the developing roller 321 shown in FIG. 4. An example of the photosensitive drum 33 is an OPC (organic photoconductor) drum.

The transfer device 34 includes a transfer roller and an intermediate transfer belt. The transfer roller transfers the toner image on the photosensitive drum 33 to the intermediate transfer belt or the sheet S.

The cleaning device 35 removes the toner T remaining on the photosensitive drum 33 after the transfer. An example of the cleaning device 35 is a cleaning blade.

The conveyance device 2 conveys the sheet S with the toner image formed thereon by the image forming device 3 to the fixing device 4.

When the above-described processor executes the control program, the control device 6 functions as a patch setter 36.

Figure 6A:
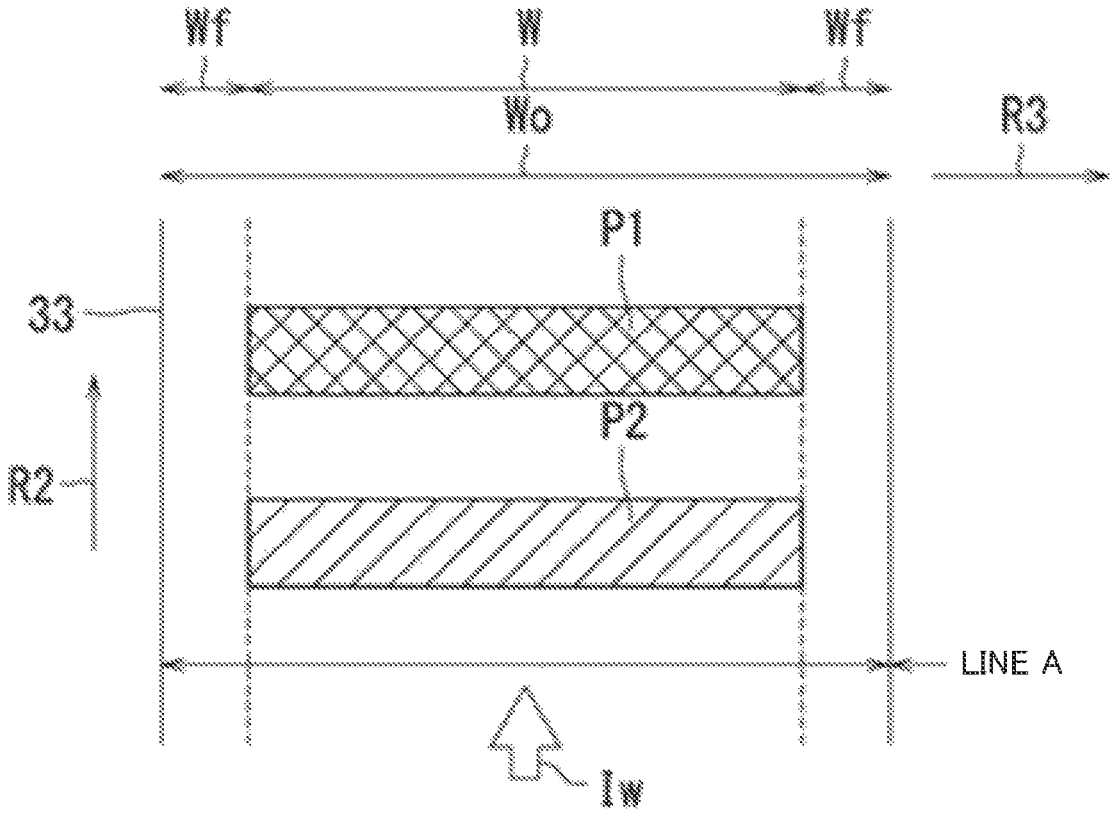
FIGS. 6A and 6B are diagrams showing flows of development current in the developing device.
Figure 6B:
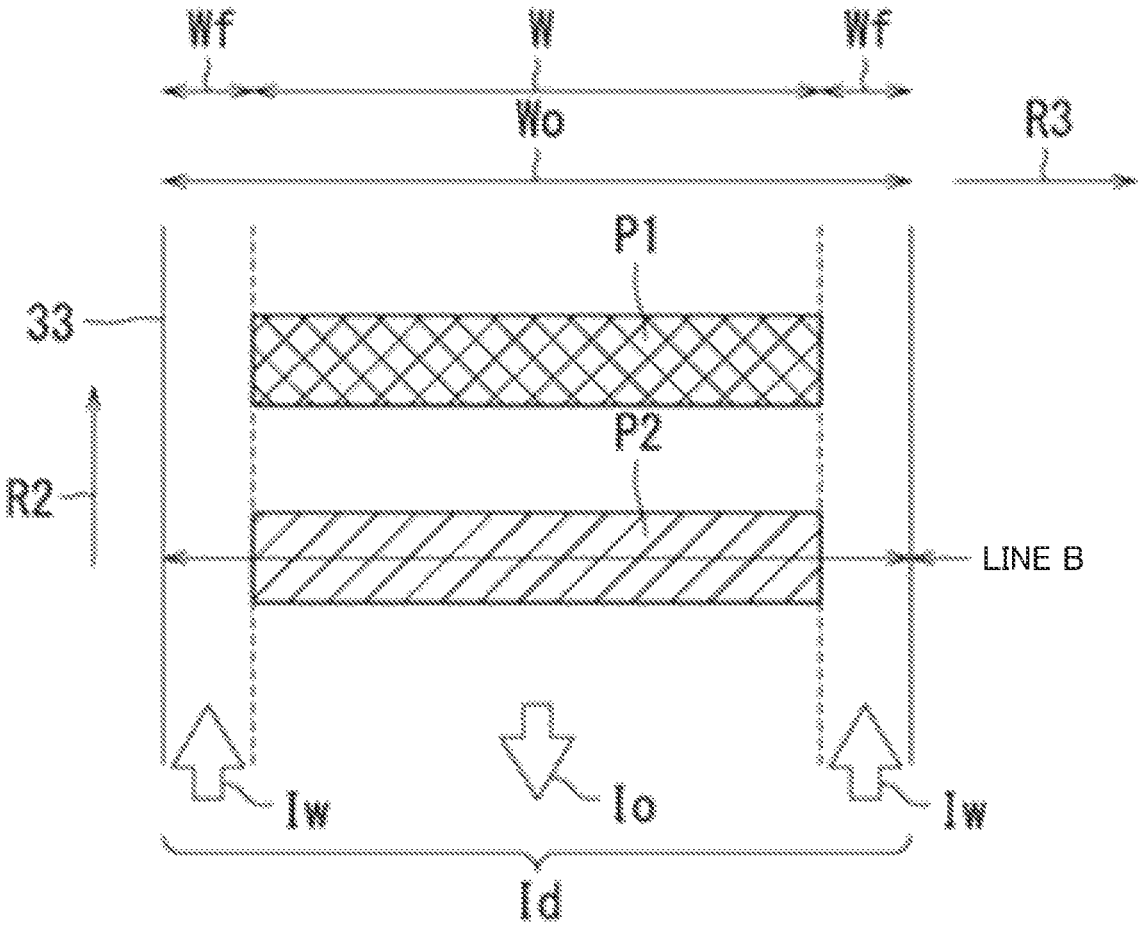
Figure 7:
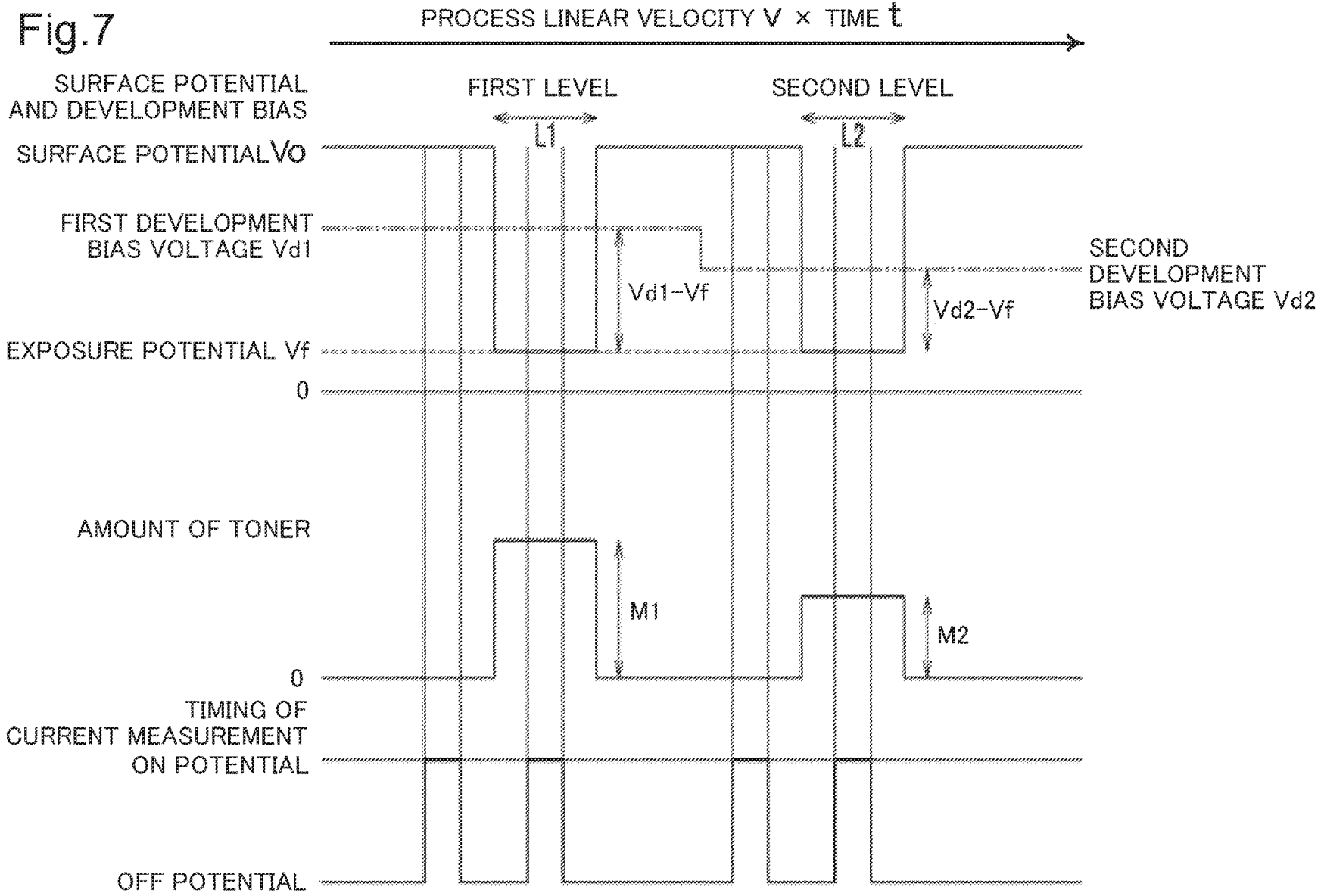
FIG. 7 is a diagram showing a relationship between potentials and amount of toner in the developing device.

Referring to FIGS. 6A and 6B, the patch setter 36 sets the amount of toner M on the toner patch P, the patch length L of the toner patch P along the rotating direction (sub-scanning direction) R2 of the photosensitive drum 33, and the toner patch width W of the toner patch P in the scanning direction R3 of the photosensitive drum 33. The toner patch P is formed on the photosensitive drum 33. The toner patch P is used for control on the toner density.

Next, the developing device 32 contained in the image forming device 3 will be described with reference to FIGS. 4 and 5. As shown in FIGS. 4 and 5, the developing device 32 includes a voltage application device 320, the developing roller 321, the first measurement device 322, the second measurement device 323, and parts of the control device 6. When the above-described processor executes the control program, the control device 6 functions as a first calculator 324, a second calculator 325, and an adjuster 326.

The voltage application device 320 applies a development bias voltage Vd to the developing roller 321.

The developing roller 321 carries a toner T.

As shown in FIG. 6A, the first measurement device 322 measures a blank portion current Iw in a first line A on the photosensitive drum 33 which extends in the scanning direction R3 of the photosensitive drum 33 and on which no toner patch P is formed. The blank portion current Iw flows from the photosensitive drum 33 toward the developing roller 321. The operation of the first measurement device 322 will be described later in detail with reference to FIGS. 6A and 6B.

As shown in FIG. 6B, the second measurement device 323 measures a measuring development current Id in a second line B on the photosensitive drum 33 which extends in the scanning direction R3 of the photosensitive drum 33 and on which a toner patch P is formed. The operation of the second measurement device 323 will be described later in detail with reference to FIGS. 6A and 6B.

The first calculator 324 calculates an actual development current Io based on the developable width Wo of the photosensitive drum 33 in the scanning direction R3, the toner patch width W of the toner patch P in the scanning direction R3, the blank portion current Iw, and the measuring development current Id.

The first calculator 324 calculates a first difference (Wo−W) between the developable width Wo and the toner patch width W and calculates the ratio (Wo−W)/Wo of the first difference (Wo−W) to the developable width Wo.

The developable width Wo and the toner patch width W have already been known. The storage device 8 may previously store the developable width Wo and the toner patch width W. In this case, the first calculator 324 can easily calculate the first difference (Wo−W) and the ratio (Wo−W)/Wo from the developable width Wo and the toner patch width W. The storage device 8 may previously store the first difference (Wo−W) and the ratio (Wo−W)/Wo.

The first calculator 324 calculates the actual development current Io by calculating the product Iw*(Wo−W)/Wo of the ratio (Wo−W)/Wo and the blank portion current Iw and calculating a second difference (Id−Iw*(Wo−W)/Wo) between the measuring development current Id and the product Iw*(Wo−W)/Wo.

The product Iw*(Wo−W)/Wo refers to a value of the blank portion current Iw in the second line B on the photosensitive drum 33 which extends in the scanning direction R3 of the photosensitive drum 33 and on which the toner patch P is formed.

[Math. 1]

$$Io = Id - \frac{(Wo - W)}{Wo} Iw \qquad \text{Formula (1)}$$

In other words, the first calculator 324 calculates the actual development current Io using the formula (1).

The second calculator 325 calculates an amount of charge on toner (Q/M) (amount of charge Q per unit amount of toner M), based on the actual development current Io.

The adjuster 326 adjusts, based on the actual development current Io, the development bias voltage Vd to be applied to the developing roller 321. In other words, the adjuster 326 adjusts the development bias voltage Vd based on the amount of charge on toner (Q/M) calculated based on the actual development current Io.

When the amount of charge on toner (Q/M) increases, the actual development current Io flowing from the developing roller 321 to the photosensitive drum 33 tends to increase. Furthermore, if the amount of charge on toner (Q/M) is high, the developability relative to the development field tends to decrease. Therefore, by adjusting the development bias voltage Vd in proportion to the calculated actual development current Io, the developability can be maintained constant and the density of the toner patch P can be maintained constant.

Next, a description will be given in further detail of the structure of the image forming device 3 with reference to FIG. 5.

As shown in FIG. 5, the control device 6 controls at least the drive deice 7, the voltage application device 320, the first measurement device 322, the second measurement device 323, the charging device 30, the exposure device 31, the developing device 32, and the cleaning device 35.

The drive device 7 drives the developing roller 321 and the photosensitive drum 33.

The voltage application device 320 is connected to the developing roller 321. The voltage application device 320 applies to the developing roller 321 a development bias voltage Vd according to the density of the image.

The developing roller 321 rotates in a direction R1. The photosensitive drum 33 rotates in a direction R2. The developing roller 321 and the photosensitive drum 33 are disposed so that their respective peripheral surfaces are opposed to each other.

The charging device 30 charges the peripheral surface of the photosensitive drum 33 with a surface potential Vo (shown in FIG. 7).

The exposure device 31 exposes the peripheral surface of the photosensitive drum 33 to laser light based on the image data. The portion of the peripheral surface of the photosensitive drum 33 exposed to light has an exposure potential Vf (shown in FIG. 7).

When the peripheral surface of the developing roller 321 and the peripheral surface of the photosensitive drum 33 come close to each other, a difference between the development bias voltage Vd of the developing roller 321 and the exposure potential Vf of the photosensitive drum 33 causes the toner T on the developing roller 321 to jump to the electrostatic latent image on the photosensitive drum 33. The electrostatic latent image on the photosensitive drum 33 is developed by the toner T at a density based on the difference between the development bias voltage Vd and the exposure potential Vf.

A development current I according to the difference between the development bias voltage Vd and the exposure potential Vf of the photosensitive drum 33 flows through the developing roller 321.

The first measurement device 322 measures the development current I. The development current I flows from the developing roller 321 to the photosensitive drum 33. Particularly, the first measurement device 322 measures a blank portion current Iw. The blank portion current Iw flows in a direction of return from the photosensitive drum 33 to the developing roller 321. Hereinafter, the development current I may be appropriately described also as the development current value I depending on the content of explanation.

Here, the blank portion current Iw will be described below. When a portion of the peripheral surface of the photosensitive drum 33 not exposed to light is located close to the peripheral surface of the developing roller 321, the potential of the peripheral surface of the photosensitive drum 33 is larger than that of the peripheral surface of the developing roller 321, so that a development current I flows reversely from the photosensitive drum 33 to the developing roller 321. This reversely flowing development current I is described particularly as a blank portion current Iw.

The second measurement device 323 measures a development current I. Particularly, the second measurement device 323 measures a measuring development current Id. The measuring development current Id is an electric current obtained by subtracting the blank portion current Iw from the actual development current Io. The actual development current Io is an electric current that flows from the developing roller 321 to the photosensitive drum 33 when a portion of the peripheral surface of the photosensitive drum 33 exposed to light is located close to the peripheral surface of the developing roller 321, because the exposed portion of the peripheral surface of the photosensitive drum 33 has a smaller potential than the peripheral surface of the developing roller 321.

The second measurement device 323 cannot directly measure the actual development current Io. The second measurement device 323 measures the measuring development current Id.

The first calculator 324 calculates the actual development current value Io by plugging the measuring development current value Id and the blank portion current value Iw measured by the first measurement device 322 into the above-described formula (1).

Next, a description will be given in further detail of the arithmetic processing of the actual development current value Io with reference to FIGS. 6A and 6B.

As shown in FIG. 6A, the photosensitive drum 33 rotates in the direction R2. The photosensitive drum 33 has a developable width Wo in the scanning direction R3. The developing device 32 forms a toner patch P (including a toner patch P1 and a toner patch P2) with a toner patch width W on the photosensitive drum 33.

The toner patch width W is smaller than the developable width Wo. Regions of the developable width Wo other than the toner patch width W are non-developing regions Wf. The patch setter 36 sets the toner patch width W. The patch setter 36 may set the density of the toner patch P. The patch setter 36 sets the density of the toner patch P1 at a higher level than the density of the toner patch P2. The storage device 8 may store the density of the toner patch P1 and the density of the toner patch P2.

As shown in FIG. 6A, when the first line A on the photosensitive drum 33 where no toner patch P is formed is located close to the developing roller 321, the development bias voltage Vd of the developing roller 321 is smaller than the surface potential Vo of the photosensitive drum 33. Therefore, a blank portion current Iw flows from the photosensitive drum 33 toward the developing roller 321.

On the other hand, as shown in FIG. 6B, when the second line B on the photosensitive drum 33 where the toner patch P2 is formed is located close to the developing roller 321, the exposure potential Vf of the photosensitive drum 33 is smaller than the development bias voltage Vd of the developing roller 321.

Therefore, within the toner patch width W on the photosensitive drum 33, an actual development current Io flows from the developing roller 321 toward the second measurement device 323. Within the non-developing regions Wf on the developing roller 321, a blank portion current Iw flows from the photosensitive drum 33 toward the developing roller 321.

As already described with reference to FIG. 5, the second measurement device 323 measures the measuring development current Id. As also described previously, the second measurement device 323 cannot directly measure the actual development current Io.

The first calculator 324 calculates the actual development current value Io by plugging the measuring development current value Id and the blank portion current value Iw measured by the first measurement device 322 into the above-described formula (1).

Next, a description will be given in further detail of the arithmetic processing of the actual development current value Io when the toner patch P1 and the toner patch P2 are formed on the photosensitive drum 33, with reference to FIG. 7.

As shown in FIG. 7, the charging device 30 charges the peripheral surface of the photosensitive drum 33 with a surface potential Vo. The exposure device 31 exposes the peripheral surface of the photosensitive drum 33 to light based on image data. The exposed portion of the photosensitive drum 33 has an exposure potential Vf When the voltage application device 320 applies a first development bias voltage Vd1 to the developing roller 321, a toner patch P1 (see FIG. 6A) is formed on the photosensitive drum 33.

The patch setter 36 sets the toner patch length L1 of the toner patch P1 in the sub-scanning direction R2. The amount of toner per unit area of the toner patch P1 is represented by an amount of toner M1. The amount of toner M1 is based on a value of (the first development bias voltage Vd1 minus the exposure potential Vf).

When the first line A on the photosensitive drum 33 where no toner patch P1 is formed is located close to the developing roller 321, the control device 6 turns an instruction to measure the electric current to an ON potential.

The first measurement device 322 measures a blank portion current Iw1.

When the second line B on the photosensitive drum 33 where the toner patch P1 is formed is located close to the developing roller 321, the control device 6 turns the instruction to measure the electric current to an ON potential.

The second measurement device 323 measures a first measuring development current Id1.

The first measuring development current Id1 flows from the developing roller 321 to the photosensitive drum 33. The first measuring development current Id1 may be appropriately described also as a first measuring development current value Id1 depending on the content of explanation.

The first calculator 324 calculates the actual development current value Io by plugging the first measuring development current value Id1 and the blank portion current value Iw1 measured by the first measurement device 322 into the formula (1).

Next, as shown in FIG. 7, when the voltage application device 320 applies a second development bias voltage Vd2 to the developing roller 321, a toner patch P2 (see FIG. 6A) is formed on the photosensitive drum 33.

The patch setter 36 sets the toner patch length L2 of the toner patch P2 in the sub-scanning direction R2. The amount of toner per unit area of the toner patch P2 is represented by an amount of toner M2. The amount of toner M2 is based on a value of (the second development bias voltage Vd2 minus the exposure potential Vf).

When the first line A on the photosensitive drum 33 where no toner patch P2 is formed is located close to the developing roller 321, the control device 6 turns the instruction to measure the electric current to an ON potential.

The first measurement device 322 measures a blank portion current Iw2.

When the second line B on the photosensitive drum 33 where the toner patch P2 is formed is located close to the developing roller 321, the control device 6 turns the instruction to measure the electric current to an ON potential.

The second measurement device 323 measures a second measuring development current Id2.

The first calculator 324 calculates the actual development current value Io by plugging the second measuring development current value Id2 and the blank portion current value Iw2 measured by the first measurement device 322 into the formula (1).

In the above-described general technique, the width of a toner patch for use in detecting a development current is set to be shorter than the maximum width of the developable region on the photosensitive drum. Within a portion of the photosensitive drum where no toner patch is formed, the surface potential of the photosensitive drum is higher than the development potential of the developing roller, so that a reverse current oriented opposite to the development current flows from the photosensitive drum toward the developing roller. Therefore, a measuring development current value measured by the current detecting device contains as an error the reverse current oriented opposite to the actual development current, which may prevent accurate measurement of the actual development current value.

Unlike the above, in the first embodiment, regarding to a portion of the photosensitive drum 33 where no toner patch P is formed, a blank portion current Iw flowing from the photosensitive drum 33 to the developing roller 321 is calculated and, thus, the actual development current value Io can be calculated from the blank portion current Iw and the measuring development current value Id.

Furthermore, in the first embodiment, the first calculator 324 can calculate the actual development current value Io using the blank portion current value Iw in the second line B on the photosensitive drum 33 where the toner patch P is formed.

Moreover, in the first embodiment, the adjuster 326 can adjust, based on the actual development current value Io, the development bias voltage Vd to be applied to the developing roller 321.

Second Embodiment

Figure 8:
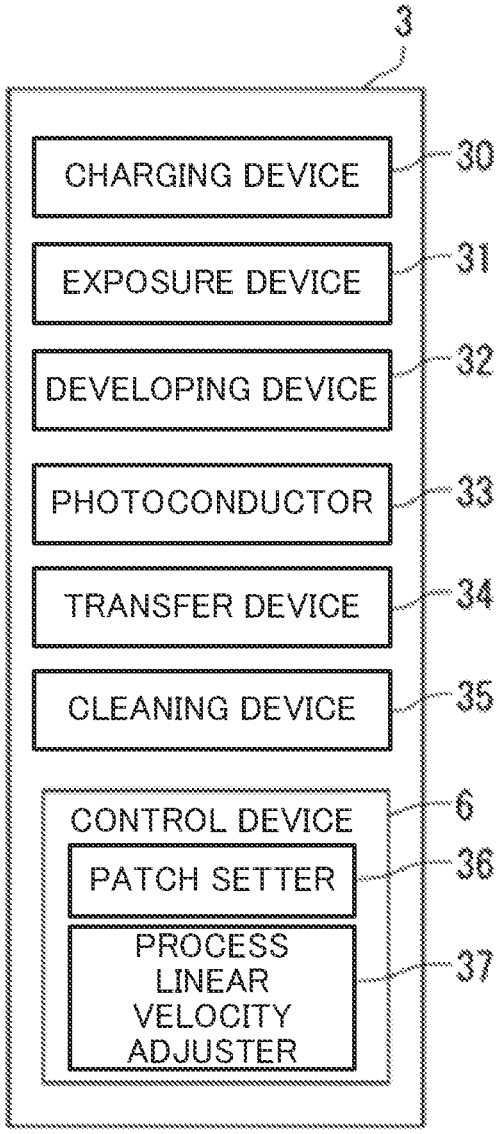
FIG. 8 is a block diagram showing another example of a configuration of the image forming device.

Next, a description will be given of an image forming apparatus 100 and an image forming system 200 both according to a second embodiment with reference to FIGS. 8 to 14B. The configuration of the image forming apparatus 100 according to the second embodiment is the same as that of the image forming apparatus 100 according to the first embodiment except that the control device 6 further functions as a process linear velocity adjuster 37. Hereinafter, a description will be given only of different points from the image forming apparatus 100 according to the first embodiment. FIG. 8 is a block diagram showing another example of a configuration of the image forming device 3. FIGS. 9A to 12B are tables showing changes of development current value I in the developing device 32 of the image forming apparatus 100 according to the second embodiment.

As shown in FIG. 8, in the image forming apparatus 100 according to the second embodiment, the control device 6 further functions as a process linear velocity adjuster 37. The process linear velocity adjuster 37 adjusts the rotational velocity of the developing roller 321, i.e., the process linear velocity v of the peripheral surface of the developing roller 321.

The patch setter 36 sets, based on the process linear velocity v, the toner patch width W of a toner patch P so that the actual development current Io falls within a predetermined range.

The image forming system 200 according to the second embodiment may include a first image forming apparatus 100A and a second image forming apparatus 100B.

The development current value I can be calculated from the following formula.

$$I=Q/M\ (\mu C/g)\times(\text{toner patch width } W\ (mm))\times(\text{process linear velocity } v\ (mm/sec))\times(\text{toner density } D\ (g/m^2)\times10^{-6}$$

FIGS. 9A to 10B show development current values I calculated for each process linear velocity v from the formula (1) when the amount of charge on toner (Q/M) is 10 to 60 (μC/g), the toner density D of the toner patch P to be developed is 1 to 6 ($g/m^2$), the toner patch width W of the toner patch P to be developed is 330 (mm), and the process linear velocity v is 200, 300, 400 or 500 (mm/sec). The preferred toner density D of the toner patch P to be developed is 3 to 5.5 ($g/m^2$).

As shown in FIG. 9A, when the process linear velocity v is 200 (mm/sec), the toner density D is 3 ($g/m^2$), and the amount of charge on toner (Q/M) is 10 (μC/g), the development current value I is 2.0 (μA).

As shown in FIG. 10B, when the process linear velocity v is 500 (mm/sec), the toner density D is 6 ($g/m^2$), and the amount of charge on toner (Q/M) is 60 (μC/g), the development current value I is 59.4 (μA).

In this case, the range of the development current value I is relatively large, so that the resolutions of the first measurement device 322 and the second measurement device 323 decrease.

To cope with this, when the process linear velocity v and the toner patch width W of the toner patch P are adjusted as shown in FIGS. 11A to 12B, the resolutions of the first measurement device 322 and the second measurement device 323 can be increased.

As shown in FIG. 11A, when the process linear velocity v is 200 (mm/sec), the toner patch width W of the toner patch P is 330 mm, the toner density D is 3 ($g/m^2$), and the amount of charge on toner (Q/M) is 10 (μC/g), the development current value I is 2.0 (μA). When the toner density D is 6 ($g/m^2$) and the amount of charge on toner (Q/M) is 60 (μC/g), the development current value I is 23.8 (μA).

Likewise, FIG. 11B shows the case where the process linear velocity v is 300 (mm/sec) and the toner patch width W of the toner patch P is 220 mm. FIG. 12A shows the case where the process linear velocity v is 400 (mm/sec) and the toner patch width W of the toner patch P is 165 mm. FIG. 12B shows the case where the process linear velocity v is 500 (mm/sec) and the toner patch width W of the toner patch P is 132 mm. In any case, when the toner density D is 3 ($g/m^2$) and the amount of charge on toner (Q/M) is 10 (μC/g), the development current value I is 2.0 (μA). When the toner density D is 6 ($g/m^2$) and the amount of charge on toner (Q/M) is 60 (μC/g), the development current value I is 23.8 (μA).

When in this manner the patch setter 36 sets the toner patch width W of the toner patch P and the process linear velocity adjuster 37 adjusts the process linear velocity v, the range of the development current value I can be narrowed, so that the resolutions of the first measurement device 322 and the second measurement device 323 can be increased. An example of the predetermined range of the development current value I is 2.0 (μA) to 23.8 (μA).

In the second embodiment, in a single image forming apparatus 100, the patch setter 36 may set the toner patch width W of the toner patch P and the process linear velocity adjuster 37 may adjust the process linear velocity v.

Figure 13A:
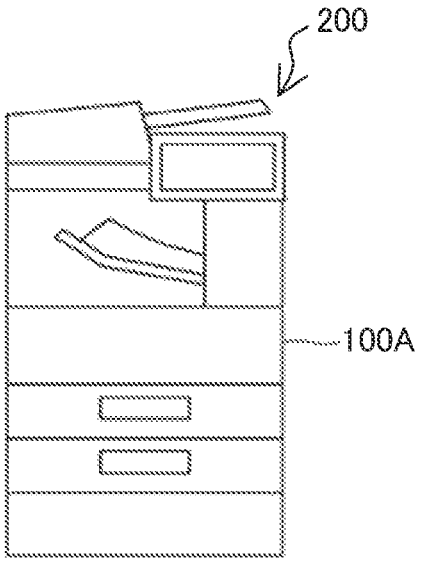
FIGS. 13A to 14B are views showing an image forming system.
Figure 13B:
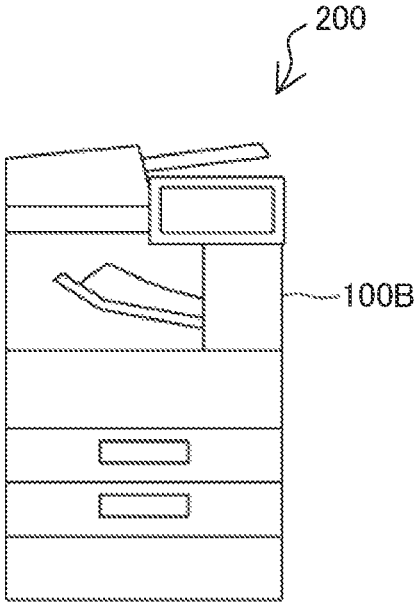
Figure 14A:
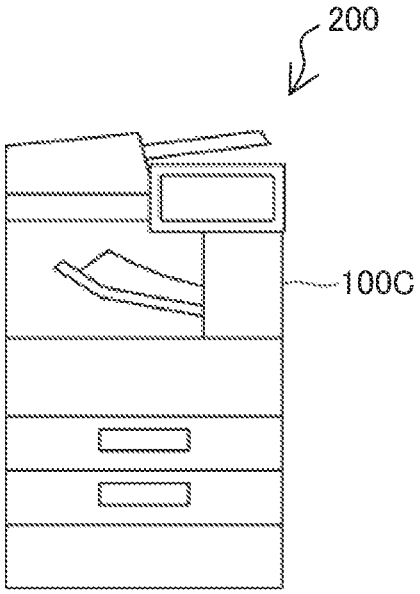
Figure 14B:
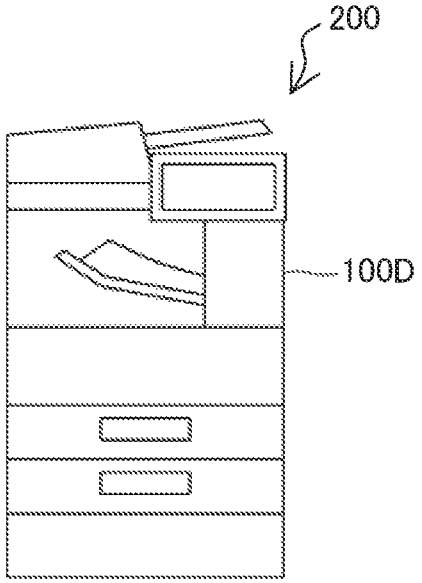

Alternatively, in the second embodiment, the image forming system 200 may include a first image forming apparatus 100A shown in FIG. 13A, a second image forming apparatus 100B shown in FIG. 13B, a third image forming apparatus 100C shown in FIG. 14A, and a fourth image forming apparatus 100D shown in FIG. 14B.

Specifically, each of the first image forming apparatus 100A shown in FIG. 13A, the second image forming apparatus 100B shown in FIG. 13B, the third image forming apparatus 100C shown in FIG. 14A, and the fourth image forming apparatus 100D shown in FIG. 14B includes a patch setter 36 and a process linear velocity adjuster 37. In each of the plurality of image forming apparatus 100A to 100D, the patch setter 36 sets the toner patch width W of the toner patch P and the process linear velocity adjuster 37 adjusts the process linear velocity v.

In the second embodiment, the first measurement device 322 and the second measurement device 323 can have a common configuration, which provides cost reduction. Furthermore, as the process linear velocity v increases, the amount of toner M of the toner patch P used to measure the amount of charge on toner (Q/M) can be reduced. Therefore, for example, the amount of toner filled in the toner container can be reduced, which provides cost reduction.

Figure 15:
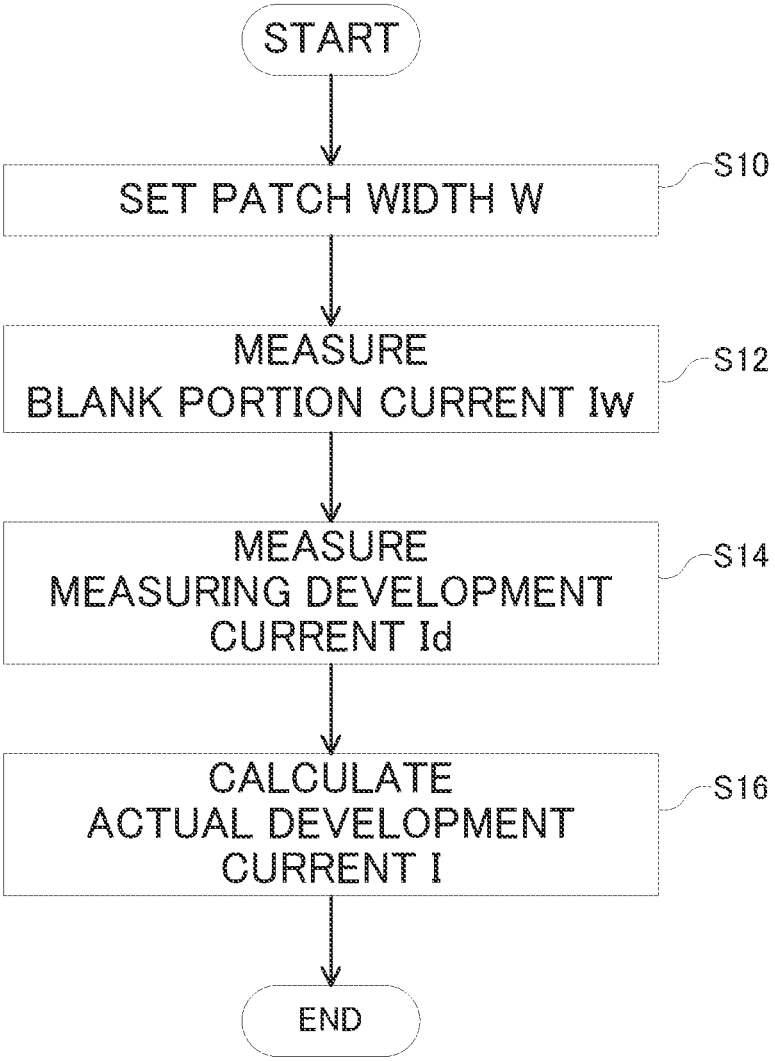
FIG. 15 is a flowchart showing processing executed by the image forming apparatus.

Next, a description will be given of processing executed by the image forming apparatus 100 with reference to FIG. 15. FIG. 15 is a flowchart showing the processing executed by the image forming apparatus 100.

As shown in FIG. 15, the flowchart includes steps S10 to S16. Specifically, the flowchart is as follows.

The patch setter 36 sets the patch width W of the toner patch P in the scanning direction R3 of the photosensitive drum 33 (step S10).

After the processing in step S10, the first measurement device 322 measures a blank portion current Iw in a first line A on the photosensitive drum 33 which extends in the scanning direction R3 of the photosensitive drum 33 and on which no toner patch P is formed (step S12).

After the processing in step S12, the second measurement device 323 measures a measuring development current Id in a second line B on the photosensitive drum 33 which extends in the scanning direction R3 of the photosensitive drum 33 and on which a toner patch P is formed (step S14).

After the processing in step S14, the first calculator 324 calculates an actual development current Io based on the developable width Wo of the photosensitive drum 33 in the scanning direction R3, the toner patch width W of the toner patch P in the scanning direction R3, the blank portion current Iw, and the measuring development current Id (step S16). After the processing in step S16, the processing ends.

The embodiments of the present disclosure have thus far been described with reference to the drawings. However, the present disclosure is not limited to the above embodiments and can be implemented in various forms without departing from the gist of the present disclosure. For the sake of ease of understanding, the drawings are schematically given by mainly showing components. The thickness of each component, the length thereof, the number of components, and so on shown in the drawings are different from those of actual components for convenience of creation of the drawings. The materials, shapes, sizes, and so on of the components described in the above embodiments are merely illustrative, not particularly limited, and can be changed variously without substantially departing from the effects of the present disclosure.

INDUSTRIAL APPLICABILITY

The present disclosure is applicable to the field of image forming apparatuses and image forming systems.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

a developing roller that carries a toner;

a photosensitive drum that carries a toner image developed from an electrostatic latent image by the toner carried on the developing roller;

a first measurement device that measures a blank portion current in a first line on the photosensitive drum which extends in a scanning direction of the photosensitive drum and on which no toner patch is formed;

a second measurement device that measures a measuring development current in a second line on the photosensitive drum which extends in the scanning direction of the photosensitive drum and on which a toner patch is formed; and a control device that includes a processor and functions, through the processor executing a control program, as (i) a patch setter that sets a patch width of the toner patch in the scanning direction of the photosensitive drum, and (ii) a first calculator that calculates an actual development current based on a developable width of the photosensitive drum in the scanning direction of the photosensitive drum, the patch width, the blank portion current, and the measuring development current.

2. The image forming apparatus according to claim 1, wherein the first calculator calculates:

a first difference between the developable width and the patch width;

a ratio of the first difference to the developable width;

a product of the ratio and the blank portion current; and a second difference between the measuring development current and the product as the actual development current.

3. The image forming apparatus according to claim 2, wherein the product represents a value of the blank portion current in the second line.

4. The image forming apparatus according to claim 1, wherein the first measurement device measures as the blank portion current an electric current flowing from the photosensitive drum toward the developing roller.

5. The image forming apparatus according to claim 1, wherein the control device further functions as an adjuster that, based on the actual development current, adjusts a development bias voltage to be applied to the developing roller.

6. The image forming apparatus according to claim 5, wherein the control device further functions as a second calculator that calculates an amount of charge on toner based on the actual development current, and the adjuster adjusts the development bias voltage based on the calculated amount of charge on toner.

7. The image forming apparatus according to claim 1, wherein the control device further functions as a process linear velocity adjuster that adjusts a process linear velocity of the developing roller, and the patch setter sets the patch width based on the process linear velocity so that the actual development current falls within a predetermined range.

8. An image forming system comprising a plurality of the image forming apparatuses according to claim 7.

* * * * *